United States Patent [19]

Bottomley

[11] 4,111,027

[45] Sep. 5, 1978

[54] ELECTROMAGNETIC APPARATUS

[76] Inventor: Alan Stuart Bottomley, 69 Queen St., Sandy Bay, Tasmania, 7005, Australia

[21] Appl. No.: 657,243

[22] Filed: Feb. 11, 1976

[30] Foreign Application Priority Data

Feb. 12, 1975 [AU] Australia ..... PC0564
Oct. 20, 1975 [AU] Australia ..... PC3629

[51] Int. Cl.[2] ..... B21D 11/04
[52] U.S. Cl. ..... 72/320; 72/457
[58] Field of Search ..... 72/319, 320, 321, 457, 72/461; 269/8; 29/DIG. 95, DIG. 105

[56] References Cited

U.S. PATENT DOCUMENTS

| | | | |
|---|---|---|---|
| 1,595,691 | 8/1926 | Simmons | 269/8 X |
| 2,302,958 | 11/1942 | Jensen | 72/319 |
| 2,429,387 | 10/1947 | Buchheim | 72/461 |
| 3,439,416 | 4/1969 | Yando | 269/8 X |
| 3,855,840 | 12/1974 | Kawano | 72/418 |

*Primary Examiner*—Leon Gilden
*Attorney, Agent, or Firm*—Murray and Whisenhunt

[57] ABSTRACT

The invention provides a tool particularly adapted for working metal. The tool comprises an electromagnetic coil, a pole adapted to be magnetized by the coil, and a work surface pivotable with respect to the pole and operative in use to apply bending force to a work piece held to the pole by magnetic force.

Keepers may be provided to be attracted to the pole to hold the work piece. A keeper may be fitted with a cutting blade or punch.

The work surface may be part of a body which, when moved from a rest position, causes the coil to be energized and which is urged by magnetic force back to that rest position to de-energize the coil.

The body is preferably connected to the pole by a hinge which does not project above a plane so as in no way to hinder metal bending.

A tool may magnetically clamp itself to a bench.

The tool may have an electrical circuit capable of producing DC for magnetic holding or AC so that the tool may be used as a demagnetizer.

18 Claims, 10 Drawing Figures

ELECTROMAGNETIC APPARATUS

BACKGROUND OF THE INVENTION

FIELD OF THE INVENTION

This invention relates to electromagnetic apparatus. In a particular aspect this invention relates to a tool. In a more particular aspect this invention relates to a tool which can be used to bend, fold and form sheet materials and which, when suitably modified, can be used to cut and punch sheet material.

The invention has particular application in the bending, folding and forming of sheet metal such as mild steel, aluminium, stainless steel, zinc sheet and galvanized iron but its use is not restricted thereto.

SUMMARY OF THE INVENTION

This invention provides a tool comprising an electromagnetic coil, a pole adapted to be magnetized by the coil, and a work surface pivotable with respect to the pole and operative in use to apply bending force to a work piece held to the pole by magnetic force.

DESCRIPTION OF PREFERRED ASPECTS

The tool preferably includes a keeper adapted to be attracted to the pole when the pole is magnetized and to hold the work piece therebetween. In general a number of such keepers will be used and will be of different size and/or shape.

In a preferred instance the tool includes switch means and the work surface is a surface of a body which is pivotable with respect to the pole from a first position in which the switch means is actuated to render the coil de-energized to a second position in which the switch means is actuated to energize the coil. In this last it is preferred that said body is comprised of a ferromagnetic material and is mounted to the pole whereby to be biased on energization of the coil from second position toward said first position.

It is also preferred that the pole includes a planar surface having an edge and wherein the work surface is planar and is adapted to pivot about an axis at least substantially co-incident with that edge.

If desired the keeper may be provided with means adapted to penetrate the workpiece on attraction of the keeper to the pole. That means may be a cutting edge or may be a punch. In the case of a punch it may be appropriate that the tool also includes a female die to co-operate with the punch.

The tool preferably has electrical means including a rectifier adapted to supply DC current to the coil and further including switch means adapted in use to connect the coil optionally to the rectifier or to an AC supply.

The tool may be in association with a support for the tool; the support being comprised of a ferromagnetic material to which the tool may attach itself by magnetic attraction thereto.

In a particularly preferred instance the pole includes a planar surface having an edge, the work surface is a planar surface of a body which, in one position of said body, lies at least substantially in the same plane as the first-mentioned planar surface, said body is pivotable about an axis at least substantially co-incident with said edge by means of a hinge comprising a recess in said pole having a semi-circular concave shape transverse to said axis and a member carried by said body having a semi-circular convexity transverse to said axis and received in said recess and wherein with said body in said position substantially no part of the pole, said member or said body projects on one side of said plane. Most preferably there is a hinge pin carried by the pole and having a semi-circular convexity transverse to said axis and received in a recess in said member having a semi-circular concave shape and wherein substantially no part of said pin projects on said one side of said plane. The tool may include a plurality of such hinges and it is desirable that at least one of said hinges is spaced from the ends of said body so that loads are more evenly distributed therealong.

The invention will now be illustrated by way of non-limiting examples with the aid of the accompanying drawings.

DETAILED DESCRIPTION

Figure 1:
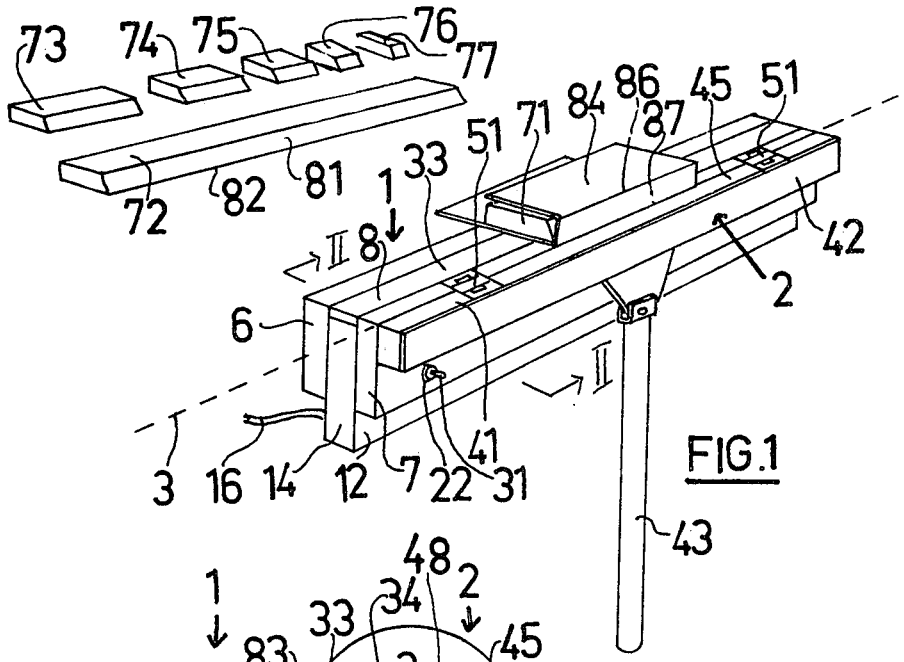
FIG. 1 is a perspective view of a tool in accordance with this invention.
Figure 2:
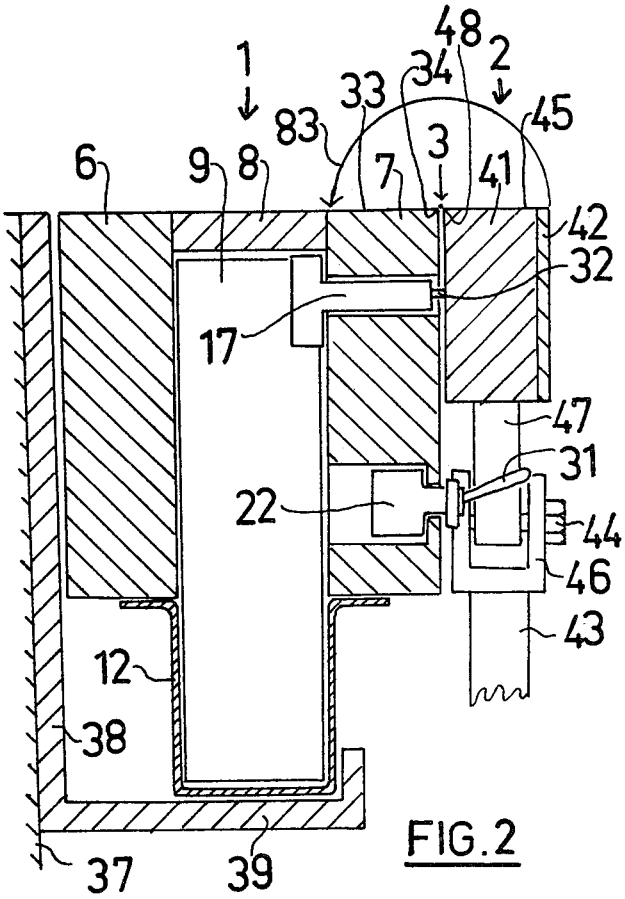
FIG. 2 is a cross-section on line II—II in FIG. 1.
Figure 3:
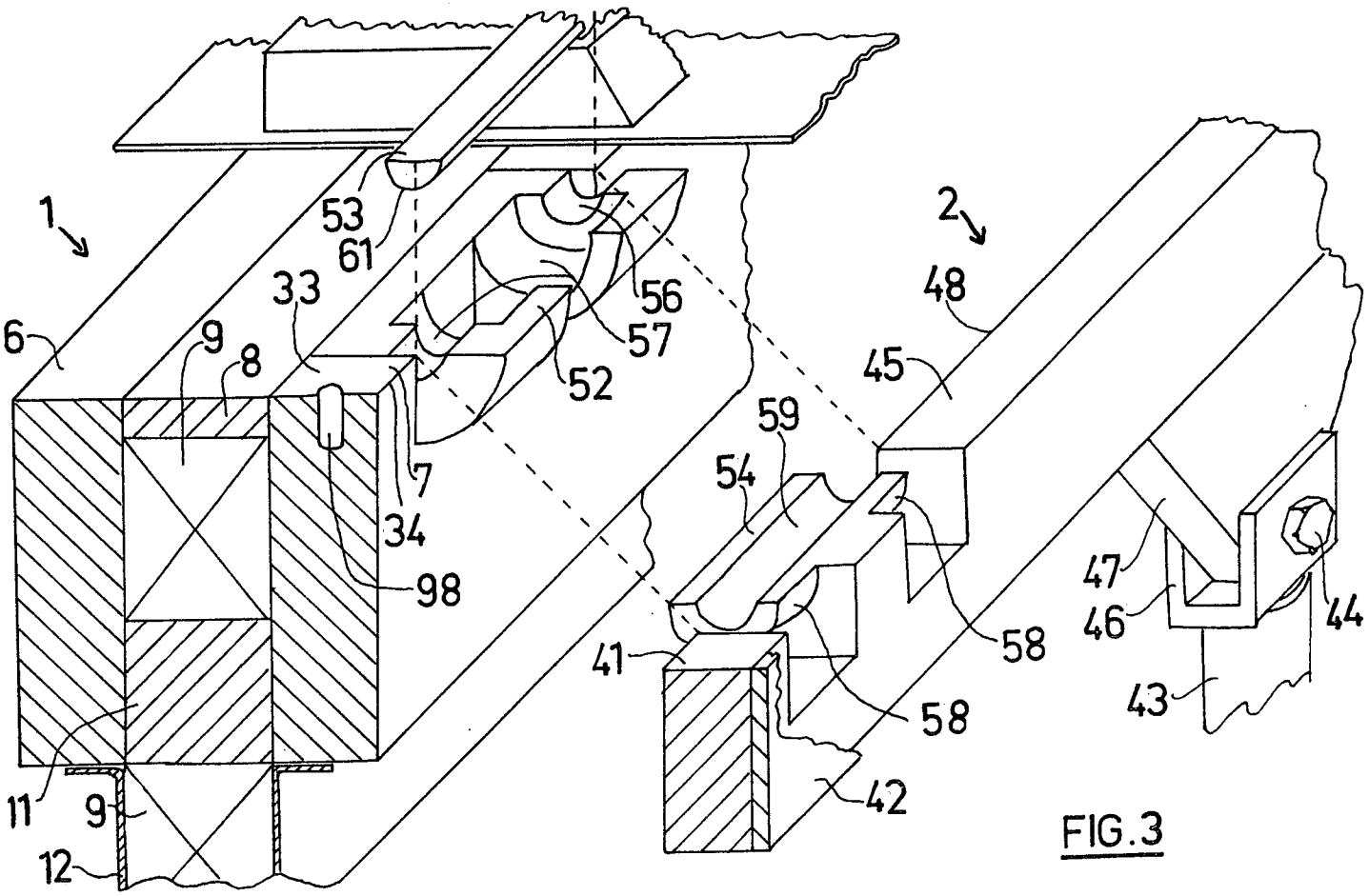
FIG. 3 is an oblique projection of part of the tool.

The tool shown in FIGS. 1–3 comprises an elongate electromagnet indicated generally by 1 and a body indicated generally by 2 which is pivotable with respect to the electromagnet 1 about an axis 3.

The electromagnet 1 comprises a back pole 6 and a front pole 7, both of ferromagnetic material. The electromagnet 1 further includes a spacer 8 of non-magnetic material such as aluminium, a coil 9, a core 11, a coil cover 12, and end covers 14. Those covers are preferably attached by screws (not shown). The core 11 is also made of ferromagnetic material and the coil 9 is made by winding wire, such as 22 guage copper wire, into a generally oval shape which is located around the core 11.

The poles 6 and 7 and core 11 are conveniently attached by bolts (not shown) and this will also serve to hold the coil 9.

It is preferred to use as the ferromagnetic material a material having a high saturation magnetisation such as iron.

The electromagnet 1 further includes electrical apparatus comprising a mains supply lead 16 which is connected to the electrical circuit of the electromagnet for supplying AC main current.

Figure 8:
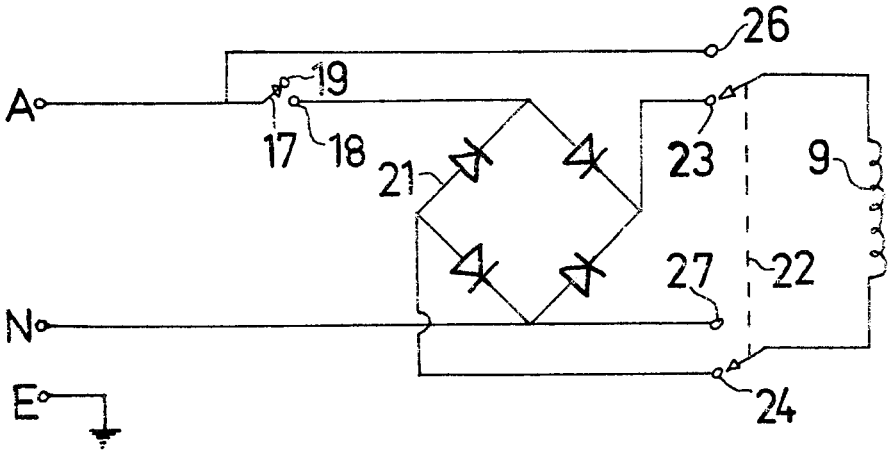
FIG. 8 is a schematic diagram of the electrical circuit of the tool.

The electrical circuit is shown in FIG. 8 and it is to be noted that the mains supply lead is connected to the active "A", neutral "N" and earth (ground) "E" terminals thereof.

The electrical circuit comprises a single pole switch 17 which is selectively switchable to terminals 18 or 19, a rectifier 21, a double pole switch 22 which is selectively switchable to terminals 23 and 24 or 26 and 27 and the coil 9.

When the switch 17 is switched to, respectively, terminals 18 or 19, current, or no current, will flow to the rectifier 21 and provided that switch 22 is switched to terminals 23 and 24 the coil 9 will be DC energized and will cause the poles 6 and 7 to be magnetized to attract ferromagnetic objects thereto.

When the switch 22 is switched to terminals 26 and 27 the rectifier 21 and switch 17 will be by-passed and the coil 9 will be AC energized and the electromagnet 1 can be used as a demagnetizer for tools or other objects.

The electrical apparatus is housed within the electromagnet in any convenient position such as behind one of the end covers 14. Electrical connections of the switches 17 and 22, coil 9 and lead 16, and the rectifier 21 are not shown in FIGS. 1–3.

The switch 22 is provided with a toggle operator 31 which desirably projects from the pole 7 below the body 2 as as shown in FIG. 2 and the switch 17 is provided with a linearly reciprocable operator 32 which desirably projects from the pole 7 in the region of the body 2 as shown in FIG. 2. The operator 31 is manually operable and the operator 32 is operable as described below.

It is to be noted that the electromagnet 1 has a planar upper surface 33 and that the edge 34 of the pole 7 is substantially co-incident with the axis 3.

Figure 6:
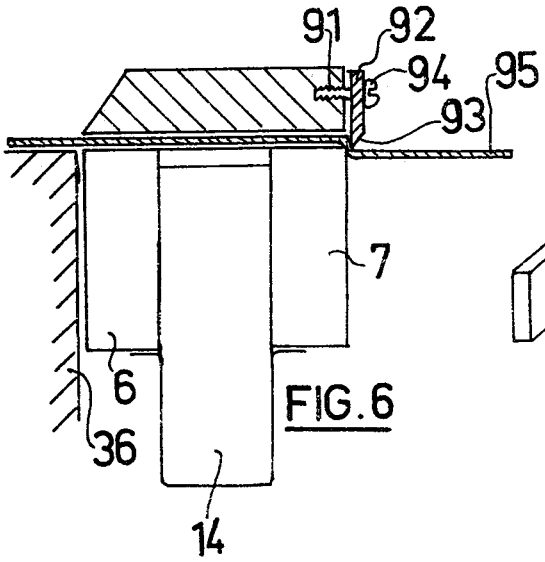
FIG. 6 is an end view of the tool and shows the device of FIG. 5 in use.
Figure 7:
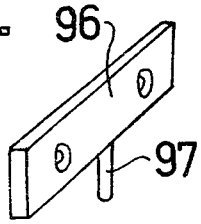
FIG. 7 is a perspective view showing another device for use with the tool.

The electromagnet 1 is conveniently mounted to a bench by means of bolts (not shown) passed through the poles 6 and 7 and core 11 and may be mounted to be flush with the upper surface of a bench 36 as is shown in FIG. 6.

However, since the electromagnet 1 will produce strong magnetic attractions it is capable of being moved from place to place and may magnetically affix itself to a support. In this respect, reference is made to FIG. 2 where a support 37 has a ferromagnetic bracket 38 affixed thereto. The electromagnet can magnetically affix itself to that bracket 38 but for purposes of support, particularly when the coil 9 of the electromagnet is not DC energized, the bracket 38 comprises a portion 39 able to support the electromagnet from beneath.

The body 2 comprises a bending beam 41 having a planar upper surface 45, a cover strip 42 which is fixed to the beam 41 by screws (not shown) and a handle 43. The handle 43 is pivotally attached to the beam 41 via bolt 44 and yoke 46 and tang 47. The handle 43 is made pivotable with respect to the beam 41 so that it may be laid parallel thereto so that the tool is in a compact folded condition for storage or transport.

The beam 2 is attached to the pole 7 by means of hinges 51. Those hinges 51 are of a particular construction so that the surfaces 33 and 45 substantially lie in one plane in one position of the body 2 (the position shown in FIGS. 1 and 2), so that in said one position no portion of the hinges 51 project above said plane and so that the axis of pivotting, 3, is substantially in said plane and substantially co-incident with the edge 34 and also edge 48 of beam 41.

The hinges 51 also include recesses 56 for receiving the ends of the pin 53 and it is to be noted that for best effect it is preferred that the ends of pin 53 be secured to the pole 7 in those recesses 56 by welding or by any other suitable means such as screws.

The cups 52 have semi-cylindrical concave surfaces 57 for receiving the semi-cylindrical convex surfaces 58 of the shells 54. The shells 54 have semi-cylindrical concave surfaces 59 for co-operating with the semi-cylindrical convex surface 61 of the pins 53.

Thus, radially, the hinges 51 each comprise cup 52, the surfaces 57 and 58, shell 54, surfaces 59 and 61 and pin 53.

Longitudinally the hinges 51 each comprise part of cup 52, shell 54 and the other part of cup 52 and it is particularly to be noted that parts of the cups 52 and shells 54 may alternate along the whole length of pole 7 and beam 41 or may alternate and extend a greater length than shown in FIG. 3.

The electromagnet 1 and body 2 will normally be used with a keeper and keepers 71–77 are shown in FIG. 1. The keepers are all made of ferromagnetic material, are generally rectangular and have a sloped surface such as surface 81.

It is further to be noted that in the position shown in FIGS. 1 and 2 the body 2 causes the operator 32 of the switch 17 to be depressed so that switch 17 is switched to terminal 19 but that on pivotting of body 2 about axis 3 the operator 32 will be released so that switch 17 is switched to terminal 18. Still further, beam 41 is made of ferromagnetic material so that when the coil 9 is DC energized it will be magnetically biased to that position to depress operator 32 and thus de-energize the coil 9.

To use the tool as a metal bender a sheet of metal is placed on the surfaces 33 and 45, a keeper of suitable length is then selected and is placed on top of the sheet and so that its edge, such as the edge 82, is on a line on the sheet on which a bend is to be made and in line with axis 3.

The switch 22 is switched to terminals 23 and 24 if not already in that condition and the handle 43 is moved to pivot the beam 41 in the direction of arrow 83. Movement of the beam 41 will release operator 32, the coil 9 will be DC energized and will attract at least the keeper to the poles 6 and 7 and the sheet will be firmly held to the electromagnet 1. The bend is then made by turning the beam 41 through the desired angle and the beam is then returned to the position shown in FIGS. 1 and 2 to de-energize the coil 9.

The sheet can then be relocated if desired and further bends can be made.

In FIG. 1 one of the keepers 71 is shown on the electromagnet and a sheet of metal 84 which has been bent at 86 and 87 is also shown.

To use the tool as demagnetizer the switch 22 is switched to terminals 26 and 27.

Figure 9:
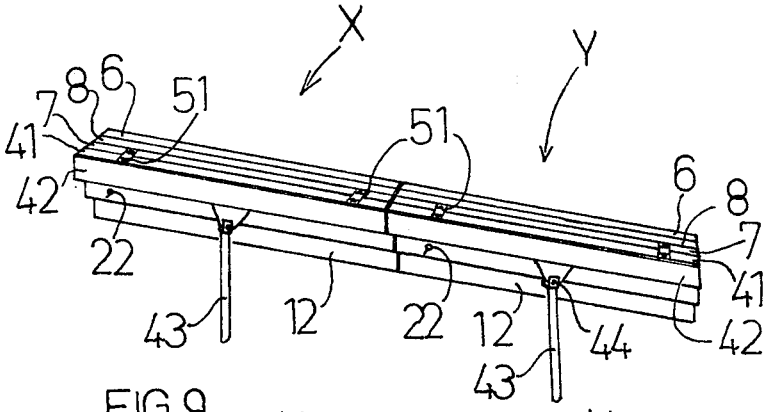
FIG. 9 is a perspective view of two of the tools aligned end-on-end.
Figure 10:
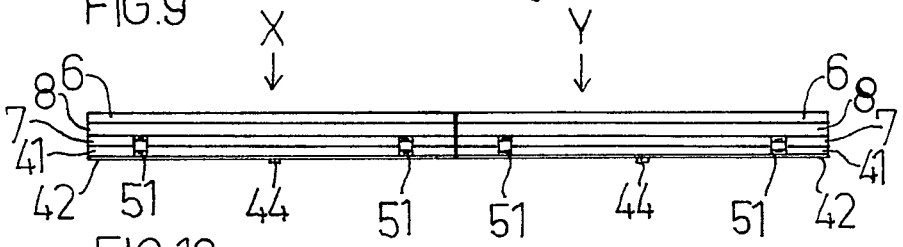
FIG. 10 is a plan view of the aligned tools of FIG. 9.

The above described tool has many advantages among which are that box sections can be easily made from sheet metal; the length of fold is not limited to the length of the tool as sheet can be advanced along the tool and bent after each advance; completely closed sections can be formed from sheet; the tool can be bench mounted so as not to occupy any bench surface and can mount itself to any ferromagnetic substrate; the tool is easily made portable, the tool is easy and quick to use; no adjustments are required to accommodate different thickness of sheet; the tool can be aligned with another such tool to effectively double its length. This alignment is illustrated in FIGS. 9 and 10, wherein a pair X,Y of the tools of the present invention have been aligned end-on-end to effectively multiply the work surface. Further, the hinges 51 will take bending forces without interfering with bending as they do not project above said plane. In this respect, bending forces are taken both by the cups 52 and pin 53. In particular it is to be noted that the hinges 51 are not restricted to being placed at the ends of the pole 7 and beam 41.

If desired, the beam 41 can be detached from the pole 7 by turning it 180° from the position shown in FIGS. 1 and 2.

A specific construction of the above described tool had a length of 600 mm, a weight of 20 kg. (not including keepers), a coil formed from 22 guage copper wire and weighing 2.4 kg., operated on a 240 volt, single phase, 50 cycles per second AC supply and consumed, intermittently, 4 amps. That specific construction was able to exert a holding force on sheet metal of about 4 tonnes.

Modifications and adaptions may be made to the above described tool.

Figure 4:
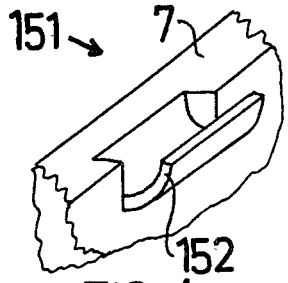
FIG. 4 is a perspective view showing a modification.

In one modification or adaption shown in FIG. 4, the hinges 51 are replaced by hinges 151 which comprise cups 152 in the pole 7 and a pin 153 which is part of the beam 41. That construction works well but is not considered as good as hinges 51, as, as well as cups 52 taking forces from shell 54, pin 53 also takes forces from shell 54. In addition, pin 153 is dependant on bending forces to retain it in cup 152.

Figure 5:
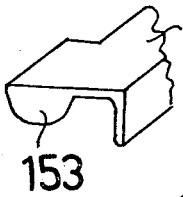
FIG. 5 is a perspective view showing a device for use with the tool.
Figure 5:
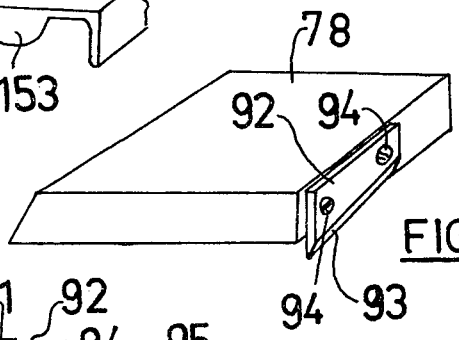

In another modification or adaption shown in FIGS. 5 and 6 a keeper 78 is provided with tapped holes 91 by means of which a plate 92 having a cutting edge 93 can be attached to the keeper 78 via screws 94. To use the keeper 78 and plate 92 the body 2 is removed and the edge 93 can be used to shear a sheet 95 as shown in FIG. 6.

An alternative to plate 92 is plate 96 provided with a punch 97 and this plate 96 can be similarly mounted to keeper 78. To facilitate punching it is preferred that a bore 98 is provided in pole 7 (see FIG. 3).

In the above described tool the hinges 51 have been shown as having parts integral with pole 7 and beam 41 but in practice the hinges are preferably separately constructed units which are received and secured in recesses in pole 7 and beam 41.

Other modifications and adaptions may be made. For instance, a plate having a cutting edge may be provided for affixing to pole 7 to co-operate with cutting edge 93. The beam 41 may have means for mounting a die, such as a recess therein for receiving a die, adapted to co-operate with keepers having complementary shape. Similarly the pole 7 may have means for mounting a die, such as a recess therein for receiving a die, adapted to co-operate with keepers having a complementary shape or with a die of complementary shape mounted to the beam 41.

If desired, one or more of the keepers may be grooved on one surface so as to facilitate locating of rod or strip therebeneath.

The claims form part of the disclosure of this Specification.

I claim :

1. A tool for bending workpieces comprising in combination:

an electromagnetic coil;

a pole adapted to be magnetized by the coil and functional in part as a supporting surface for the workpiece;

a ferromagnetic keeper having an edge or surface against which a workpiece may be formed, and adapted to be maintained in a working position, in direct opposition to bending or forming forces, entirely by magnetic force arising from a magnetic flux produced on energization of said coil, and a work surface means pivotable with respect to the pole to place the plane of said work surface means at least substantially in the same plane as the supporting surface of the pole with substantially no part of said pole or said work surface means projecting on one side of said same plane, and operative in use to apply bending force to the workpiece.

2. A tool as claimed in claim 1 and including a number of such keepers of different size and/or shape.

3. A tool as claimed in claim 1 and including switch means and wherein the work surface means is a surface of a body which is pivotable with respect to the pole from a first position in which switch means is actuated to render the coil de-energised to a second position in which the switch means is actuated to energise the coil.

4. A tool as claimed in claim 3, where said body is comprised of a ferromagnetic material and is mounted to the pole whereby to be biased on energisation of the coil from said second position toward said first position.

5. A tool as claimed in claim 1, wherein the pole includes a planar surface having an edge and wherein the work surface is planar and is adapted to pivot about an axis at least substantially co-incident with that edge.

6. A tool as claimed in claim 1, wherein the keeper is provided with means adapted to penetrate the workpiece on attraction of the keeper to the pole.

7. A tool as claimed in claim 1, and including electrical means including a rectifier adapted to supply DC current to the coil and further including switch means adapted in use to connect the coil optionally to the rectifier or to an AC supply.

8. A tool as claimed in claim 1 and in association with a support for the tool; the support being comprised of a ferromagnetic material to which the tool may attach itself by magnetic attraction thereto.

9. A tool as claimed in claim 1, wherein the pole includes a planar surface having an edge, the work surface means is a planar surface of a body which, in one position of said body, lies at least substantially in the same plane as the first-mentioned planar surface, said body is pivotable about an axis at least substantially co-incident with said edge by means of a hinge comprising a recess in said pole having a semi-circular concave shape transverse to said axis and a member carried by said body having a semi-circular convexity transverse to said axis and received in said recess and wherein with said body in said position substantially no part of the pole, said member or said body projects on one side of said plane.

10. A tool as claimed in claim 9 and including a plurality of such hinges.

11. A tool as claimed in claim 10, wherein at least one of said hinges is spaced from the ends of said body.

12. A tool as claimed in claim 9, and including a hinge pin carried by the pole and having a semi-circular convexity transverse to said axis and received in a recess in said member having a semi-circular concave shape and wherein substantially no part of said pin projects on said one side of said plane.

13. A tool as claimed in claim 12 and including a plurality of such hinges and wherein at least one of said hinges is spaced from the ends of said body.

14. A tool for bending workpieces comprising magnetizable pole means for supporting at least part of said workpiece;

electromagnetic coil means for magnetizing said pole means;

work surface means, pivotable with respect to said pole means, for applying bending force to a workpiece held on said pole means entirely by magnetic force; and ferromagnetic keeper means, having an area against which a workpiece may be formed, for magnetically retaining said workpiece on said pole means in direct opposition to bending forces applied to said workpiece by said work surface means.

15. Tool of claim 14, wherein said area is an edge of the said keeper means.

16. A tool for bending workpieces comprising a pole means including a first planar surface defined in part by an edges;

work surface means having a second planar surface and pivotable from a first position to a second position about an axis at least substantially coincident with said edge, said second planar surface lying at least substantially in the same plane as said first planar surface when said work surface means is in said first position, with substantially no part of said pole means or said work surface means projecting on one side of said plane, and work surface means applying bending force to a workpiece on said pole means and said work surface means when said work surface means is moved from said first position to said second position;

ferromagnetic keeper means, having an edge or surface against which a workpiece may be formed; and magnetizing means for magnetizing said pole means to magnetically hold said workpiece and said keeper means to said pole means entirely by magnetic force in direct opposition to bending forces applied to said workpiece by said work surface means.

17. Tool of claim 16, wherein no part of said tool except said keeper means is above said first planar surface when said work surface means is in said first position.

18. Tool of claim 17, wherein a plurality of said tools can be end-on-end aligned to effectively multiply the work surface.

* * * * *